United States Patent [19]

Sokolova et al.

[11] 3,931,539

[45] Jan. 6, 1976

[54] SUPERORTHICON-TYPE TELEVISION CAMERA TUBE HAVING TARGET AND FINE-MESH METAL GRID COATED WITH SEMICONDUCTOR MATERIAL OF RELATIVELY LOW INELASTIC ELECTRON REFLECTION FACTOR

[76] Inventors: Pasha Lvovna Sokolova, Udelny prospekt 55, kv. 2; Boris Vasilievich Krusser, Antonovsky pereulok, 3, kv. 24, both of Leningrad, U.S.S.R.

[22] Filed: June 13, 1973

[21] Appl. No.: 369,762

[30] Foreign Application Priority Data

Apr. 12, 1968 U.S.S.R. ..... 1232167

[52] U.S. Cl. ..... 313/377; 313/94

[51] Int. Cl.[2] ..... H01J 31/36; H01J 31/08

[58] Field of Search ..... 313/65 R, 65 T

[56] References Cited

UNITED STATES PATENTS

| | | | |
|---|---|---|---|
| 2,518,434 | 8/1950 | Lubszynski | 313/65 T |
| 2,922,906 | 1/1960 | Day et al. | 313/65 T |
| 3,001,098 | 9/1961 | Schneeberger | 313/67 X |
| 3,179,834 | 4/1965 | Ochs | 313/89 |
| 3,437,860 | 4/1969 | Ney | 313/65 T |
| 3,509,414 | 4/1970 | Einstein | 313/65 R X |

*Primary Examiner*—Robert Segal

*Attorney, Agent, or Firm*—Waters, Schwartz & Nissen

[57] ABSTRACT

A superorthicon-type television camera tube with a photoelectric cathode, a target spaced opposite the cathode and including a film and a fine mesh grid arranged between the film and the cathode. A coating is provided on both the grid and the film and is constituted of a semiconductor material having an inelastic electron reflection factor lower than that of the material of the target. The coating of semiconductor material is on the film and on the grid on the side facing the cathode.

8 Claims, 2 Drawing Figures

Figure 1:
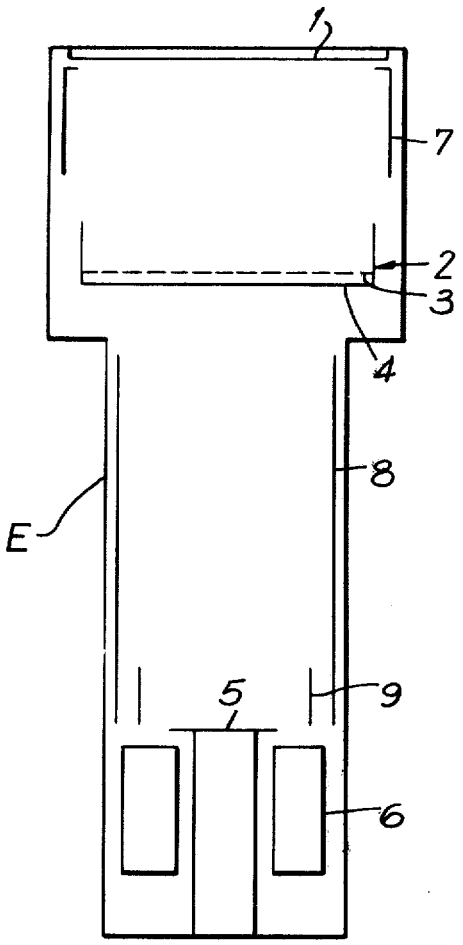

SUPERORTHICON-TYPE TELEVISION CAMERA TUBE HAVING TARGET AND FINE-MESH METAL GRID COATED WITH SEMICONDUCTOR MATERIAL OF RELATIVELY LOW INELASTIC ELECTRON REFLECTION FACTOR

The present invention relates to television engineering and, more particularly to superorthicon-type television camera tubes designed for high-quality color and black-and-white television broadcasting, for systems used for recording television images, etc.

Known in the art are television camera tubes of the superorthicon type which employ a target-grid assembly comprising a target consisting of a glass film and a fine-mesh metal grid.

These television camera tubes have the following disadvantages: a comparatively low signal-to-noise ratio, a narrow range of illumination of half tones transmitted without distortion (in particular, dark half tones are poorly transmitted), inadequate contrast of the fine details of the image, critical tuning when selecting the working illumination, and an adverse influence of the white on the quality of the picture being transmitted. All these disadvantages result from the fact that the secondary current excited by the photoelectric current from the film and grid of the target has an essential portion of high-speed electrons which under the effect of the electric field return back to the target in the form of a scattered flow resulting in a secondary emission from the film with a coefficient higher than unity. As a result, an additional (spurious) charge is stored not only on the portions of the target corresponding to the illuminated areas of the photoelectric cathode, but also on these which correspond to the non-illuminated areas of the photoelectric cathode, and this leads to a decrease in the contrast of the picture charge at the target.

Also known in the art are television camera tubes of the superorthicon type whose target is made in the form of a fine-mesh metal grid and a very thin film of magnesium of aluminum.

The disadvantage of these tubes consists in fragility of the thin films which are subject to microphonic interference. Furthermore, these targets are transparent to photoelectrons, and this adversely affects the quality of the television image when increasing the illumination.

Superorthicon-type television camera tubes are also known in which in order to increase the signal-to-noise ratio, the target as viewed from the photoelectric cathode is coated with a layer of material which features a lower secondary emission coefficient than that of the film, for example, a layer of silver.

However, any decrease of the secondary-emission factor of the film results in a drop in the sensitivity of the television camera tube due to the reduced amplification of the photoelectric current at the target.

An object of the present invention is to provide a television camera tube of the superorthicon type which is free from the above disadvantages.

A specific object of the invention is to provide television camera tubes of the superorthicon type which have a higher signal-to-noise ratio, a wider illumination range of undistorted television transmission, better telecast of half tones of the image, particularly dark half tones, higher contrast when transmitting fine details of the television picture, and which at the same time are not so critical to any change in the illumination and to any variation in the white color content in the scene being telecast the latter fact being very important for high-quality television broadcasting, especially for color television.

This object has been accomplished by providing a superorthicon-type television camera tube in which the film and fine-mesh metal grid have a coating which, according to the invention, is made of a semiconducting material having an inelastic electron reflection factor lower than that of the material of the film.

It is advantageous that a secondary electron emission factor of the employed semiconductor material is not lower than the secondary electron emission factor of the material of the uncoated film. In this case the resistivity of the material of the coating should not be higher than that of the material of the film.

For example, oxides of magnesium, aluminum or lithium as well as various combinations of these oxides may be used as the semiconductor material.

Figure 2:
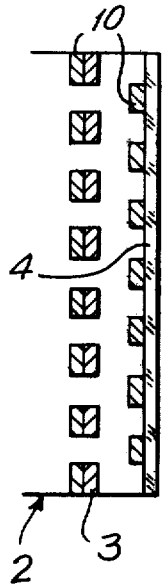

Other more specific objects and advantages of the invention will be apparent from the following description of some embodiments thereof taken in conjunction with the appended drawings, in which:

FIG. 1 schematically shows a superorthicon-type television camera tube, according to the invention; and FIG. 2 is a sectional view of a target provided with a coating according to the invention.

The superorthicon-type television camera tube comprises in an evacuated envelope E photoelectric cathode 1 (FIG. 1), a target grid assembly 2 consisting of a grid 3 and a film 4, a gun 5, a secondary emission multiplier 6, an accelerating electrode 7, a focusing electrode 8 and a cylinder 9 of the multiplier 6.

FIG. 2 illustrates the target 2 having a coating 10 applied onto the grid 3 and film 4.

The superorthicon-type television camera tube operates in the following manner.

The focused optical image of the picture being transmitted is projected onto the photoelectric cathode 1. In accordance with the distribution of the light and shades on the photoelectric cathode, the photoelectronic image under the action of the accelerating and focusing electric fields is focused on the target 2 causing a secondary emission from the surfaces of the film 4 and grid 3 of the target 2 which are irradiated by the photoelectrons. As a result, the useful charge is stored on the film 4 of the target 2. The charge stored on the target is read off when being commutated by the beam of low-speed electrons produced by the gun 5. The back current of the beam, modulated by the picture charge on the target 4, is fed to the secondary emission multiplier 6 and after amplification therein produces a video signal at the output of the superorthicon.

The coating 10 (FIG. 2) of semiconducting material, having an inelastic electron reflection factor lower than that of the film and applied on the grid 3 and film 4 of the target 2 on the side of the photoelectric cathode 1, decreases the percentage of high-speed electrons in the secondary current excited by the photoelectrons from the grid 3 (FIG. 1) and film 4 of the target 2, and correspondingly reduces the spurious charge decreasing the contrast in the picture charge on the target 4 and in the output video signal, narrowing the illumination range of the undistorted telecast, deteriorating the transmission of the dark half tones and detail contrast, and leading to that the quality of the television picture is strongly affected by the white color content in the scene being transmitted. The critical tuning in selecting the working illumination is also due to this spurious charge on the target. Therefore, by using a suitable coating of on the film and grid of the target on the side facing the photoelectric cathode, the disadvantages of the known superorthicon television camera tubes can be almost completely eliminated.

When selecting a required coating material, it is advisable to use the known relationship between the inelastic electron reflection factors and the effective atomic numbers of the elements or compounds. It is clear from this relationship that the elements and compounds having the least effective atomic numbers possess the least inelastic electron reflection factors. In order to keep constant (or to increase) the sensitivity of the tube with the coating used, the secondary-electron emission factor of the selected material should be no less than the secondary-electron emission factor of the uncoated film of the target. To maintain the serviceability of the tube with a coated target film under the prescribed resolution conditions, the resistivity of the coating should not exceed that of the uncoated film. The coating material is constituted of a semiconductor material having an inelastic electron reflection factor lower than that of the material of the film. The resistivity of the material does not exceed that of the material of the film.

Oxides of magnesium, aluminum, lithium and their various compounds meet all these requirements.

The coating of the film and grid of the target with the selected semiconductor material can be effected by means of vacuum evaporation of this material and deposition of the vapors of the semiconductor material onto the assembled target on the side facing the grid both before and after mounting the grid into the tube.

The basic advantage of the present invention consists in that the use of the proposed coating for the grid and film of the target on the side facing the photoelectric cathode makes it possible to increase the signal-to-noise ratio by 40 percent, to widen the illumination range of the undistorted telecast by a factor of 5 to 10, to considerably improve the transmission of the dark half tones and to drastically increase the contrast when transmitting the fine details of the television image. A very important advantage of the proposed tubes consists in that they are much less critical to the white color content in the scene being telecast as well as to the selection of the working illumination when tuning the tube.

Though the present invention has been described with reference to a preferred embodiment thereof, it is understood that various changes and modifications can be made in the construction and arrangement of parts without departing from the scope of the present invention as defined by the appended claims.

We claim:

1. A superorthicon-type television camera tube comprising a photoelectric cathode, a target spaced opposite the cathode, said target including a film, said film being subject to secondary emission upon exposure to a photoelectric image and storing a resulting charge, a fine-mesh metal grid between said film and said cathode, a coating on both said grid and film of the target and of a semiconductor material having an inelastic electron reflection factor lower than that of the material of said film, semiconductor material being selected from the group comprising oxides of magnesium, aluminum, lithium and compounds of said oxides, said grid having a side facing the cathode and a side facing the target, said coating being on the side of the grid facing said cathode, an electron gun for scanning said target, and an evacuated envelope in which said cathode, target and gun are located.

2. A television camera tube as claimed in claim 1, wherein the semiconductor material is a material having a secondary-emission factor not less than the secondary-emission factor of the material of said film.

3. A television camera tube as claimed in claim 1, wherein the semiconductor material is a material having resistivity not higher than that of the material of said film.

4. A television camera tube as claimed in claim 1, wherein said grid is spaced from said film.

5. A television camera tube as claimed in claim 1, wherein said target is a glass film.

6. A television camera tube as claimed in claim 1, wherein the coating on the film is spaced from the coating on the grid.

7. A television camera tube as claimed in claim 1, wherein the film has a side facing the cathode and a side facing away from the cathode and the coating on the film is on the side of the film facing the cathode.

8. A television camera tube as claimed in claim 1, wherein the coating on the grid is solely on the side facing the cathode.

* * * * *